US006695670B1

(12) United States Patent
Driscoll et al.

(10) Patent No.: US 6,695,670 B1
(45) Date of Patent: Feb. 24, 2004

(54) ELECTRONIC YO-YO GAMES

(76) Inventors: Robert W. Driscoll, C/O 42 Warren Ter., Longmeadow, MA (US) 01106; Edward Wood, C/O 42 Warren Ter., Longmeadow, MA (US) 01106; Peter Kristoffy, C/O 42 Warren Ter., Longmeadow, MA (US) 01106

( * ) Notice: Subject to any disclaimer, the term of this patent is extended or adjusted under 35 U.S.C. 154(b) by 0 days.

(21) Appl. No.: 09/525,968

(22) Filed: Mar. 15, 2000

Related U.S. Application Data

(60) Provisional application No. 60/124,343, filed on Mar. 15, 1999.

(51) Int. Cl.[7] ..... A63F 13/00

(52) U.S. Cl. ..... 446/242; 463/1; 273/142 R

(58) Field of Search ..... 446/242, 250, 446/247, 236; 273/369; 362/196, 802; 368/250; 324/171; 377/23; 463/1, 15, 30–33, 36–39

(56) References Cited

U.S. PATENT DOCUMENTS 3,162,979 A * 12/1964 Garoogian ..... 446/242
3,924,114 A * 12/1975 Sanchez ..... 362/196
4,327,518 A * 5/1982 Knauff ..... 46/228
4,775,948 A * 10/1988 Dial et al. ..... 368/250
4,820,979 A * 4/1989 Schwerdhofer et al. ..... 324/171
4,867,727 A * 9/1989 Lanius ..... 362/802
4,875,675 A * 10/1989 Arad et al. ..... 446/247
5,145,444 A * 9/1992 VanKuiken ..... 446/242
5,356,328 A * 10/1994 Ho ..... 446/242
5,446,775 A * 8/1995 Wright et al. ..... 377/23
5,791,966 A * 8/1998 Capps et al. ..... 446/242
6,077,145 A * 6/2000 Ma ..... 446/247
6,083,076 A * 7/2000 Saint-Victor ..... 446/236
6,287,193 B1 9/2001 Rehkemper

OTHER PUBLICATIONS

Tiger Electronis E–Yo Instruction Manual, 1999.*
Joe Blundo "When it comes to choosing toys, kids know best" 2 pages, Feb. 11, 1999.*
The Dallas Morning News Person@l Technology Jul. 13, 1999.*

* cited by examiner

*Primary Examiner*—Jessica Harrison
*Assistant Examiner*—Y Cherubin
(74) *Attorney, Agent, or Firm*—Deborah A. Basile

(57) ABSTRACT

The invention teaches the combination of a common toy, the yo-yo, and an electronic hand-held game playing device. To date, these two areas have not been combined and certainly have not been interactive. Specifically, the invention consists of an electronic circuit embedded into the disk of a yo-yo such that typical yo-yo game playing interfaces with the electronic game. The electronic game may be the LCD-type games similar to current hand-held games with the exception that the player must use typical yo-yo game playing actions to play the LCD game. The electronic LCD game will utilize the LCD to display game results and graphics while the yo-yo sensor and switches will provide game input. In addition, the invention discloses electronic games based on audio sound effects, similar to current non-LCD electronic hand-held games with the exception that player must use typical yo-yo game playing to play the game.

8 Claims, 5 Drawing Sheets

ELECTRONIC YO-YO GAMES

CROSS-REFERENCE TO RELATED APPLICATIONS

Provisional Patent Application Ser. No. 60/124,343, filed Mar. 15, 1999.

MICROFICHE APPENDIX

Not applicable

STATEMENT REGARDING FEDERALLY SPONSORED RESEARCH AND DEVELOPMENT

Not Applicable.

BACKGROUND OF THE INVENTION

1. Field of the Invention

The inventors have created a yo-yo which has hand-held electronic game-playing capabilities. The action of activating the yo-yo provides the main interface to the electronic games through the rotation of the yo-yo, the rotation speed of the yo-yo and the duration of the rotation of the yo-yo.

2. Description of the Related Art

Currently in the field of art, there are yo-yos which have circuit boards disposed within them and a plurality of light emitting diodes mounted on the circuit boards to be controlled by the circuit boards. Switches are controlled by centrifugal forces generated by the rotation of the yo-yo and in some cases a speaker is also provided within the yo-yo structure to generate a sound when the yo-yo is rotated. Thus, the prior art contains yo-yo's with electric light and sound, yo-yo's with speed measurement and display and yo-yo's with digital watches or with means to calculate the number of yo-yo revolutions. The prior art does not however teach an electronic game that is triggered by yo-yo play.

BRIEF SUMMARY OF THE INVENTION

The invention consists of a yo-yo with an electronic circuit or circuits contained within its body. The electronics will include a micro-controller or similar state machine to monitor switch and/or sensor input and control an LCD (liquid crystal display) and/or a speaker. The sensor which detects motion, the switches, the LCD screen and speaker device are all included in Electronic Yo-Yo Games. The invention combines electronic game play with yo-yo game play. The prior art does not teach the use of yo-yo play patterns as the main interface for playing electronic games. The prior art has electronic games that are hand-held. There are yo-yo's with electronics for turning on lights or light-emitting diodes. There are yo-yos with electronics for measuring the speed and duration of a yo-yo spin. There is, however, no electronic game-playing yo-yo.

The invention is based on the concept of embedding an electronic circuit into a yo-yo to use the yo-yo action or typical yo-yo game play as the main interface in playing electronic games. The electronic games may be LCD games similar to current hand-held LCD games with the exception that the player must use yo-yo actions or typical yo-yo game play to play the electronic game. The LCD games utilize an LCD screen to display game results and graphics while the yo-yo sensor and switches provide game input. Further, electronic games are based on audio sound effects similar to current non-LCD electronic hand-held games with the exception that players must use yo-yo game play or yo-yo action to play the electronic game. The non-LCD games use a speaker and electronic speech and/or sound effects to provide game output to the player, while the yo-yo sensor and switches will provide game input. There are also electronic yo-yo games that combine an LCD and a speaker for both visual and audio feedback to the player. Further, there are games that make use of LED's or light emitting diodes for visual feedback to the player. The extent to which the yo-yo actions are used to control game play may vary depending upon the game design. Finally, there will be a set of yo-yo games that will make use of either IR or RF (IR if the line-of-sight between yo-yo's is open, otherwise it will be RF) technology to allow similar yo-yo's to communicate with each other. This communication will result in either typical communication, such as sending messages, or it will allow two or more players to compete against each other simultaneously with each player controlling their own yo-yo.

When playing an Electronic Yo-Yo Game, the player must spin the yo-yo to advance in the game. The invention does not simply place an electronic game into a yo-yo apparatus but it uses typical yo-yo game play (spinning it for speed, spinning it for duration or rolling it along the ground) as inputs to electronic games or as necessary components to actually play the electronic game. Another strong point of difference is that there are no yo-yo's that make use of IR or RF communications.

Thus, the present invention is an electronic game that has unique and unlimited interface opportunities. For example, a fishing game whereby the duration of the spin of the yo-yo is the equivalent of the distance that the fishing line is cast. Similarly, a car racing game, where the speed at which the yo-yo is spun is directly related to the speed that the car races. With a communications link between yo-yo's, these products will allow yo-yo players to compete against each other simultaneously at electronic games.

PREFERRED EMBODIMENT OF THE INVENTION

Figure 1:
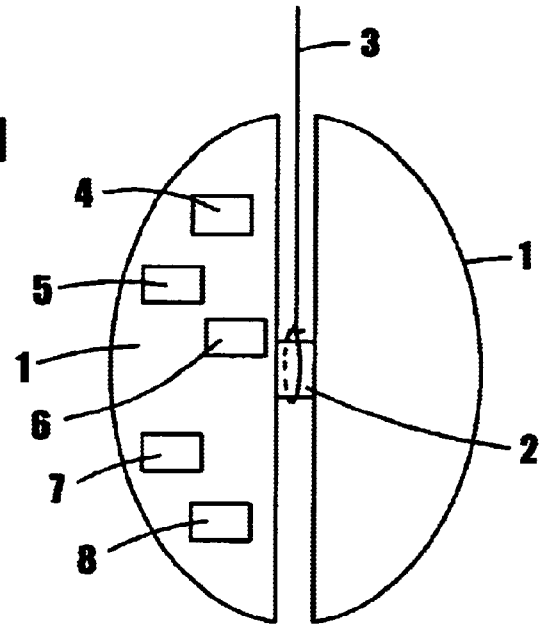
FIG. 1 depicts a side view of an exemplary yo-yo.
Figure 2:
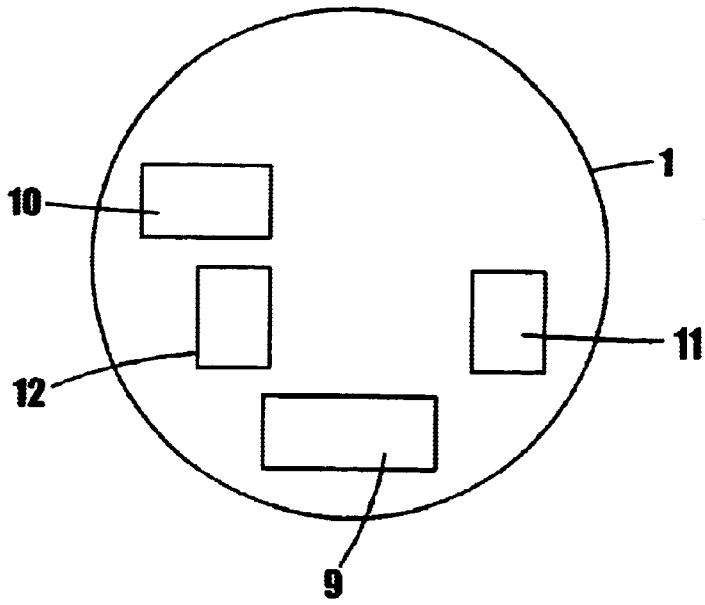
FIG. 2 depicts a view of the front of an exemplary yo-yo.
Figure 3:
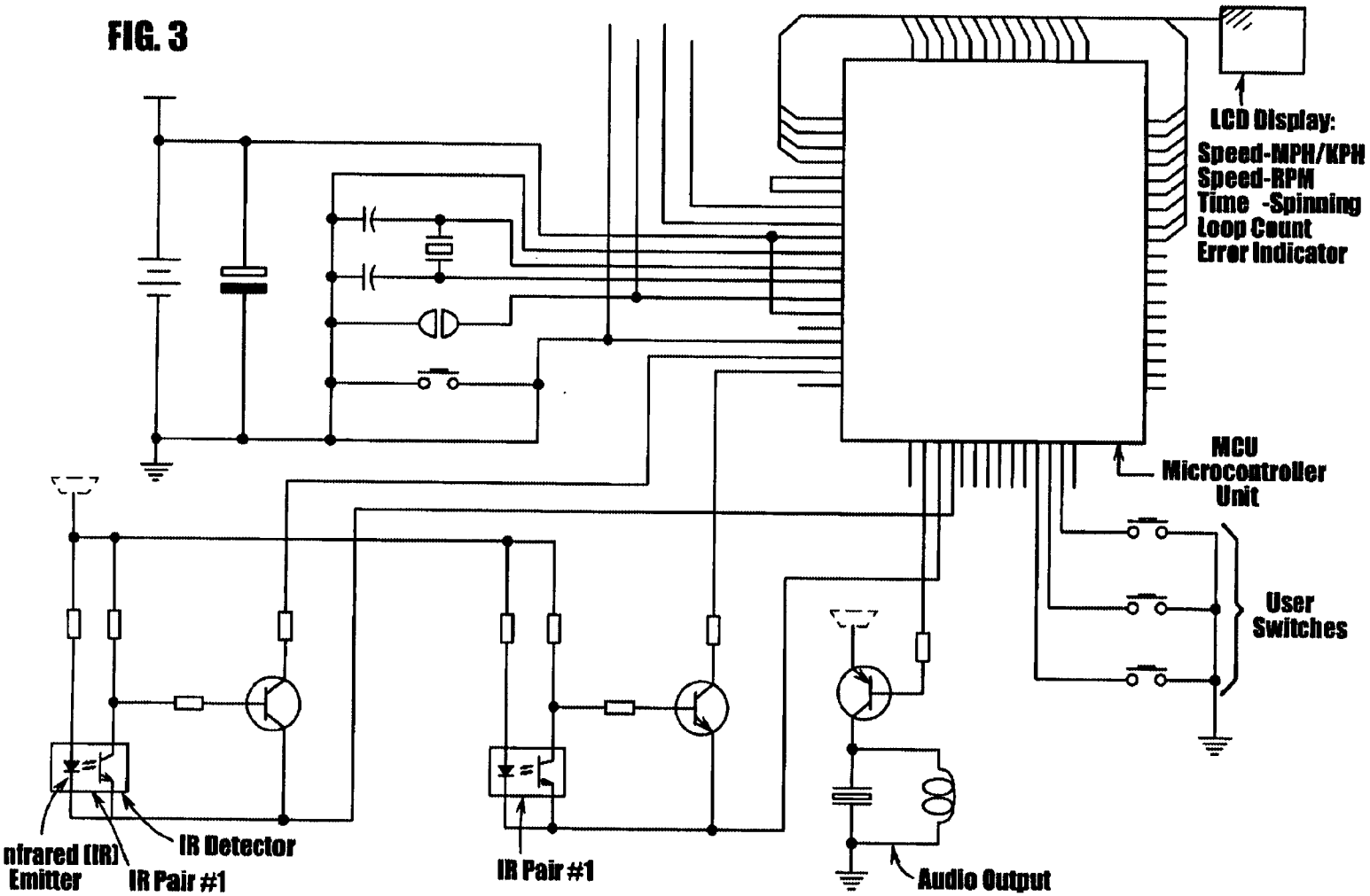
FIG. 3 depicts an exemplary yo-yo application circuit.

Referring to FIGS. 1 and 2, the preferred embodiment consists of two identical disk embers (1), an axle (2) which connects them and holds them apart, the string (3), loosely connected to the axle (2), electronics, which are all located in one of the disk members (1) as follows:

1. Electronics to measure spin (4), electronics to measure speed (5), in RPMs and the duration of the spin in typical yo-yo game play.
2. Electronics to calculate an overall score based upon a combination of the speed and the duration (6).
3. Electronics to calculate the scale speed in miles per hour (7) of the yo-yo based upon the known circumference of the yo-yo. Once the MPH is calculated, the yo-yo can calculate the distance which the yo-yo would have traveled if it were rolling along a flat plane.

4. Electronics will save high scores in memory (9).
5. Electronics will include a sound transducer, either a speaker or a piezo device which will provide audio signals, tones, speed or other sounds which will alert the player when its current play has exceeded a high score for any of the scoring categories (8).
6. The invention will convey results measured or calculated to the player through liquid crystal display screens (10), light-emitting diodes (11) or via a speaker or electronic speech (8).
7. Results can also be transmitted to similar yo-yos via infrared or radio frequency technology (12). Two or more players will thus be able to compete against each other by having their respective yo-yos compare scores via this communication link.

Figure 4:
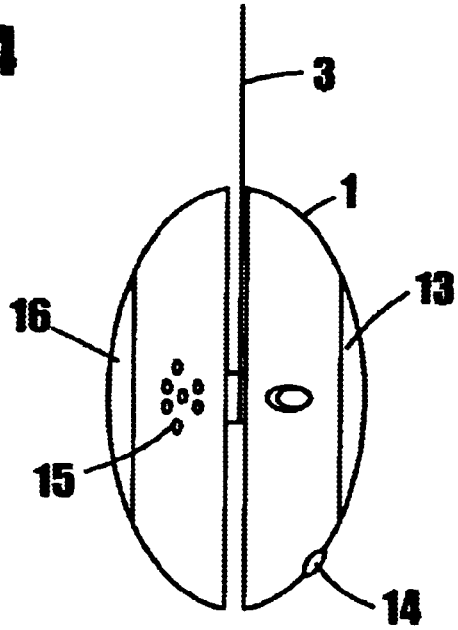
FIG. 4 depicts a side view of an exemplary yo-yo showing exterior components.

Referring to FIG. 4, one of the disk members (1) will have an LCD lens cover (13). The other disk member will have a switch (14) and a mini-speaker (15) and a battery door (16).

Figure 5:
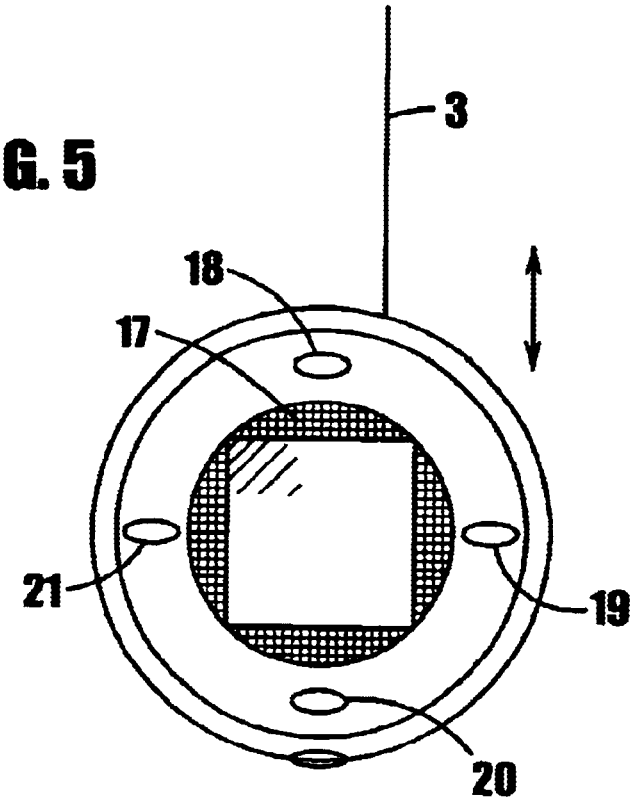
FIG. 5 depicts a front view of an exemplary yo-yo showing exterior components.

Referring to FIG. 5, one of the disk members will have an LCD screen (17), a start key switch (18), a right key switch (19), an on-off key switch (20) and a left key switch (21).

Figure 6:
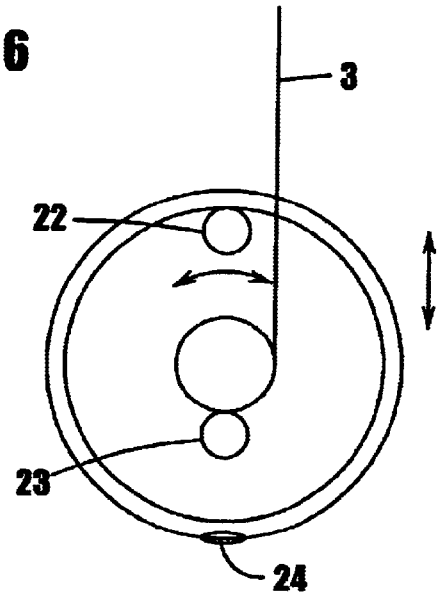
FIG. 6 depicts a cross-sectional view of an exemplary yo-yo showing internal sensors.

Referring to FIG. 6, within one of the disk members is a motion sensor above the axle (22), a motion sensor below the axle (23) and a touch sensor below the axle (24).

Figure 7:
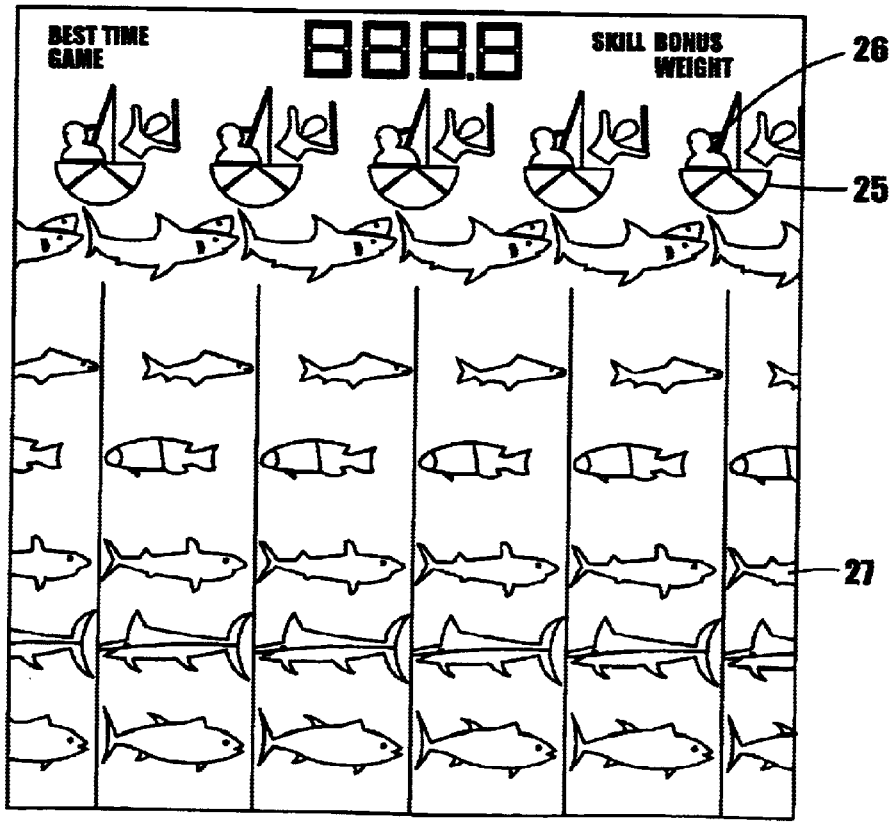
FIG. 7 depicts an exemplary LCD fishing game screen.

Referring to FIG. 7, in order to play an electronic game, for example the fishing yo-yo game, the player will move the arrow keys or switches on the outside of one of the disk members, which will in effect move the fishing boat (25) back and forth across the top of the LCD screen. When the yo-yo is played, in other words allowed to descend the string, that action is equivalent to casting the fishing line. The LCD display screen shows a fishing boat (25), with a fisherman (26), which moves back and forth across the top of the screen. The screen also shows six different types of fish (27) swimming back and forth below the boat at various depths. If the fisherman, being a player, casts out his line by spinning the yo-yo, then the fishing line is also shown on the LCD screen. It sinks to various depths depending upon the force of the yo-yo spin and/or the duration of the yo-yo spin.

The player watches the fish swimming back and forth beneath the boat. The object of the game is to catch as many fish as possible in a limited amount of time (one or two minutes). In order to catch a fish, the player must maneuver the boat in front of the fish and cast his line. The depth of the cast is completely dependent upon how long the player is able to spin the yo-yo or have the yo-yo sleep at the bottom of the string. The value and size of the fish increases as the depth increases. Players must learn how to get the yo-yo to sleep fairly well in order to cast out to the lower depths. The player that can learn to sleep the yo-yo longer will be able to score more points. The yo-yo also rewards players that can learn to sleep their yo-yos consistently. The fishing line must be cast in exactly the right depth in order to catch a fish. The line must stop at the depth of the fish in order to catch it. Sleep time equals cast depth. Thus, yo-yo play completely controls the game. This embodiment of the invention is shown on FIG. 7 which depicts the LCD screen for the fishing yo-yo game.

Figure 8:
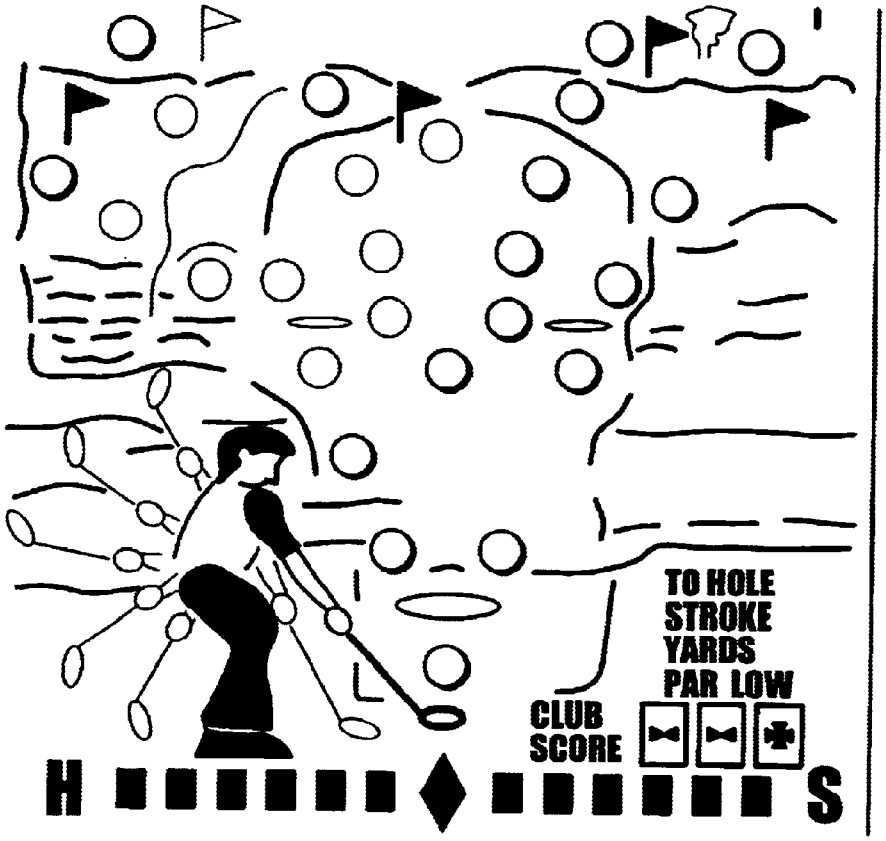
FIG. 8 depicts an exemplary LCD golf game screen.

Other games embodied within the invention include LCD Golf Yo-Yo (FIG. 8), wherein the player will play an 18-hole course complete with water hazards. The LCD screen will show a moving bar graph and the player must time the throw of the yo-yo according to the bar graph in order to aim the ball. A second yo-yo action, the duration of the spin or the number of rotations will determine how hard the ball is hit. The player will swing his club by spinning the yo-yo and the result of his shot will be displayed on the screen once the yo-yo returns to rest in the player's hand.

Other games are developed by the inventors which also utilize yo-yo play to trigger electronic game play without an LCD screen. In these embodiments, electronics will create audio signals which will indicate which type of yo-yo spin is required by the player to earn points. For example, a short tone requires a short spin and a long tone requires a long spin. A drawn out tone requires that the player make the yo-yo sleep.

We claim:

1. A yo-yo toy structure comprising:

a body having two identical disks members, each having an inner surface and an outer surface, said disk members being mounted on an axle in such a way as to define a space between said inner surfaces of said disk members;

a string which is loosely engaged around said axle within said space between said inner surfaces of said disk members;

two dome-like cover members respectfully mounted on the outer surfaces of said disk members;

a first electronic means within one of said disk members to measure a spin speed of said disk members in rotations per minute;

a second electronic means within one of said disk members to measure a duration of spin of said disk member;

a third electronic means within one of said disk members to calculate an overall score;

a fourth electronic means within one of said disk members to calculate a scale of speed in miles per hour of said disk members and an equivalent distance; and an electronic sound transducer within one of said disk members to provide audio signals, tones, speech or audible sound;

wherein said first through fourth electronic means are used to play an electronic game programmed in the yo-yo toy structure.

2. A yo-yo toy structure of claim 1 wherein said electronic means includes a memory feature to store information relative to game play such as high scores in each of the following categories: speed, time, distance and overall score, said memory feature having electronic recall mechanism to enable a user to receive prior scores and compete against prior scores.

3. The yo-yo toy structure of claim 2 wherein one of said disk members has embedded within it electronic means for a liquid crystal display and said dome-like cover member of said disk member having a liquid crystal display screen.

4. The yo-yo structure of claim 3 wherein said member has imbedded within it light-emitting diodes.

5. A yo-yo toy structure comprising of:

a body having two identical disks members, each having an inner surface and an outer surface, said disk members being mounted on a axle in such a way as to define a space between said inner surfaces of said disk members;

a string which is loosely engaged around said axle within said space between said inner surfaces of said disk members;

two dome-like cover members respectfully mounted on the outer surfaces of said disk members;

electronic means within one of said disk members to measure the spin speed of said disk members in rotations per minute;

electronic means within one of said disk members to measure the duration of spin of said disk member;

electronic means within one of said disk members to calculate an overall score;

electronic means within one of said disk members to calculate the scale of speed in miles per hour of said disk members and the equivalent distance;

an electronic sound transducer within one of said disk members to provide audio signals, tones, speech or audible sound;

said electronic means includes a memory feature to store information relative to game play such as high scores in each of the following categories: speed, time, distance and overall score, said memory feature having electronic recall mechanism to enable a user to receive prior scores and compete against prior scores;

one of said disk members has embedded within it electronic means for a liquid crystal display and said dome-like cover member of said disk member having a liquid crystal display screen;

said member has imbedded within it light-emitting diodes which may be viewed through said dome-like cover member of said disk members;

one of said disk members has embedded within it electronic means for receiving and transmitting infrared or radio frequency communication such that two or more players may exchange information and compete against each other.

6. The yo-yo toy structure of claim 5 having an electronic circuit or circuits containing a micro-controller or means to monitor switch and sensor input; and having a battery compartment and a mini-speaker embedded within one of said disk members and having a motion sensor in contact with said axle and a motion sensor in contact with said disk member and having a touch sensor on said dome-like cover member of said disk member and having switches around the perimeter of said dome-like cover member of said disk member, wherein said sensors send information back to said micro-controller.

7. The yo-yo toy structure of claim 6 having embedded within it electronic means for a liquid crystal display and said dome-like cover member of said disk member having a liquid crystal display screen, which is controlled by said micro-controller to display information sent from said sensors.

8. The yo-yo toy structure of claim 6 having said sensors and said switches and wherein said audio electronic means triggers game play by audio signals transmitted to the player through said speaker.

* * * * *